US008408170B2

(12) United States Patent
Kardos et al.

(10) Patent No.: US 8,408,170 B2
(45) Date of Patent: Apr. 2, 2013

(54) COOLING FAN FOR INTERNAL COMBUSTION ENGINE HAVING AXIALLY ADJUSTABLE FAN ROTOR

(75) Inventors: Zoltan Kardos, Södertälje (SE); Erik Söderberg, Stockholm (SE)

(73) Assignee: Scania CV AB (SE)

( * ) Notice: Subject to any disclaimer, the term of this patent is extended or adjusted under 35 U.S.C. 154(b) by 219 days.

(21) Appl. No.: 12/989,669

(22) PCT Filed: Feb. 26, 2009

(86) PCT No.: PCT/SE2009/050211

§ 371 (c)(1),
(2), (4) Date: Oct. 26, 2010

(87) PCT Pub. No.: WO2009/134185

PCT Pub. Date: Nov. 5, 2009

(65) Prior Publication Data

US 2011/0036311 A1 Feb. 17, 2011

(30) Foreign Application Priority Data

Apr. 28, 2008 (SE) ..... 0800960

(51) Int. Cl.
*F01P 7/00* (2006.01)

(52) U.S. Cl. ..... 123/41.59; 123/41.12; 123/41.49; 123/41.65; 165/51; 416/169 A

(58) Field of Classification Search ..... 123/41.49, 123/41.59, 41.65, 41.12; 165/41, 51; 416/169 A
See application file for complete search history.

(56) References Cited

U.S. PATENT DOCUMENTS

| | | | | |
|---|---|---|---|---|
| 2,995,295 | A * | 8/1961 | Day | 416/133 |
| 4,340,123 | A * | 7/1982 | Fujikawa | 180/68.1 |
| 4,387,780 | A | 6/1983 | Fujikawa | |
| 6,021,747 | A * | 2/2000 | Gee et al. | 123/41.12 |
| 6,600,249 | B2 * | 7/2003 | Nelson et al. | 310/91 |
| 7,063,125 | B2 * | 6/2006 | Tembreull et al. | 165/41 |
| 7,789,049 | B2 * | 9/2010 | Duley | 123/41.47 |
| 2007/0098547 | A1 * | 5/2007 | Vinson et al. | 415/173.1 |

FOREIGN PATENT DOCUMENTS

| | | | |
|---|---|---|---|
| EP | 2151345 | A2 * | 2/2010 |
| JP | 5904316 | A | 3/1984 |

OTHER PUBLICATIONS

International Search Report dated Apr. 22, 2009, issued in corresponding international application No. PCT/SE2009/050211.

* cited by examiner

*Primary Examiner* — Noah Kamen
*Assistant Examiner* — Grant Moubry
(74) *Attorney, Agent, or Firm* — Ostrolenk Faber LLP

(57) ABSTRACT

A cooling fan (10) for a vehicle engine (50), having a fan casing (60) and a fan rotor (12) which is movable axially relative to the fan casing during operation. There is an actuator (20) for moving the fan rotor (12) to positions which represent various degrees of protrusion (a) from an end of the fan casing (60) in order to optimise the fan's suction capacity and efficiency on the basis of current operating parameters such as fan speed and vehicle velocity.

10 Claims, 4 Drawing Sheets

COOLING FAN FOR INTERNAL COMBUSTION ENGINE HAVING AXIALLY ADJUSTABLE FAN ROTOR

CROSS-REFERENCE TO RELATED APPLICATIONS

The present application is a 35 U.S.C. §§371 national phase conversion of PCT/SE2009/050211, filed Feb. 26, 2009, which claims priority of Swedish Application No. 0800960-7, filed Apr. 28, 2008, the contents of which are incorporated by reference herein. The PCT International Application was published in the English language.

TECHNICAL FIELD

The invention relates to a cooling fan for a vehicle engine, comprising a fan casing and a fan rotor which is movable axially relative to the fan casing during operation.

BACKGROUND

There are various known ways of controlling cooling fans for vehicle engines in order to save fuel by adapting their suction action to varying cooling requirements during operation. A commonly used method is to intermittently disconnect the driving power from the fan rotor in response to decreasing cooling requirement. Other solutions provide various ways of regulating the speed of the fan according to the cooling requirement.

A cooling fan with axially movable fan rotor is known from JP59046316 A, in which the rotor shaft is capable of linear movement against the force of a spring so that increasing engine speed causes the rotor to be drawn by its own suction force towards a constriction in the fan casing in order to increase the cooling air flow. In a cooling fan referred to in U.S. Pat. No. 4,387,780, the rotor is movable axially by a variable belt transmission upon increase in the speed of the belt transmission.

SUMMARY OF THE INVENTION

An object of the invention is to provide an improved cooling fan installation of the kind indicated in the introduction in which the axial position of the fan rotor can be varied more definitely with a view to increasing the efficiency of the fan.

According to a version of the invention, the cooling fan has an actuator for moving the rotor to positions which involve different amounts of protrusion from an end of the fan casing in order to optimise the fan's suction capacity and efficiency on the basis of current operating parameters such as fan speed and vehicle velocity. For example, when the cooling requirement is low, it is possible even at high fan speeds to allow the fan's suction power to decrease, and thereby save energy, by the actuator moving the fan rotor to a reduced-load position partly outside the fan casing.

The cooling fan may comprise sensors for detection of magnitudes relating to the cooling requirement, and a control unit for switching the actuator in response to signals from the sensors.

Although many different types of sensors may be used for detecting the cooling requirement, it is possible in an embodiment for them to comprise a temperature sensor for detection of cooling fluid temperature.

The actuator may be a fluid-powered actuator, in which case it is possible to use, for example, an existing compressed air source in the vehicle to power the actuator. However, other types of actuator may also be used.

The actuator may further comprise a cylinder and a piston rod.

The fan rotor may be supported for rotation relative to the piston rod, in which case the actuator may be adapted to supporting the rotor.

The cooling fan may have a telescopic shaft for the fan rotor, which shaft extends through the actuator, making it unnecessary for the actuator to be dimensioned for supporting only the rotor.

The telescopic shaft may be a drive shaft for the fan rotor. This embodiment may be used where the fan is driven by, for example, the crankshaft of the vehicle engine.

However, the fan rotor may also be driven by a belt transmission, in which case a hub of the rotor may comprise a pulley for a driving belt of the belt transmission.

Other features and advantages of the invention may be indicated by the claims and the following description of embodiments.

BRIEF DESCRIPTION OF THE DRAWINGS

In the drawings, items with similar functions in the various embodiments are provided with the same reference numbers.

DETAILED DESCRIPTION OF EMBODIMENTS

Figure 1:
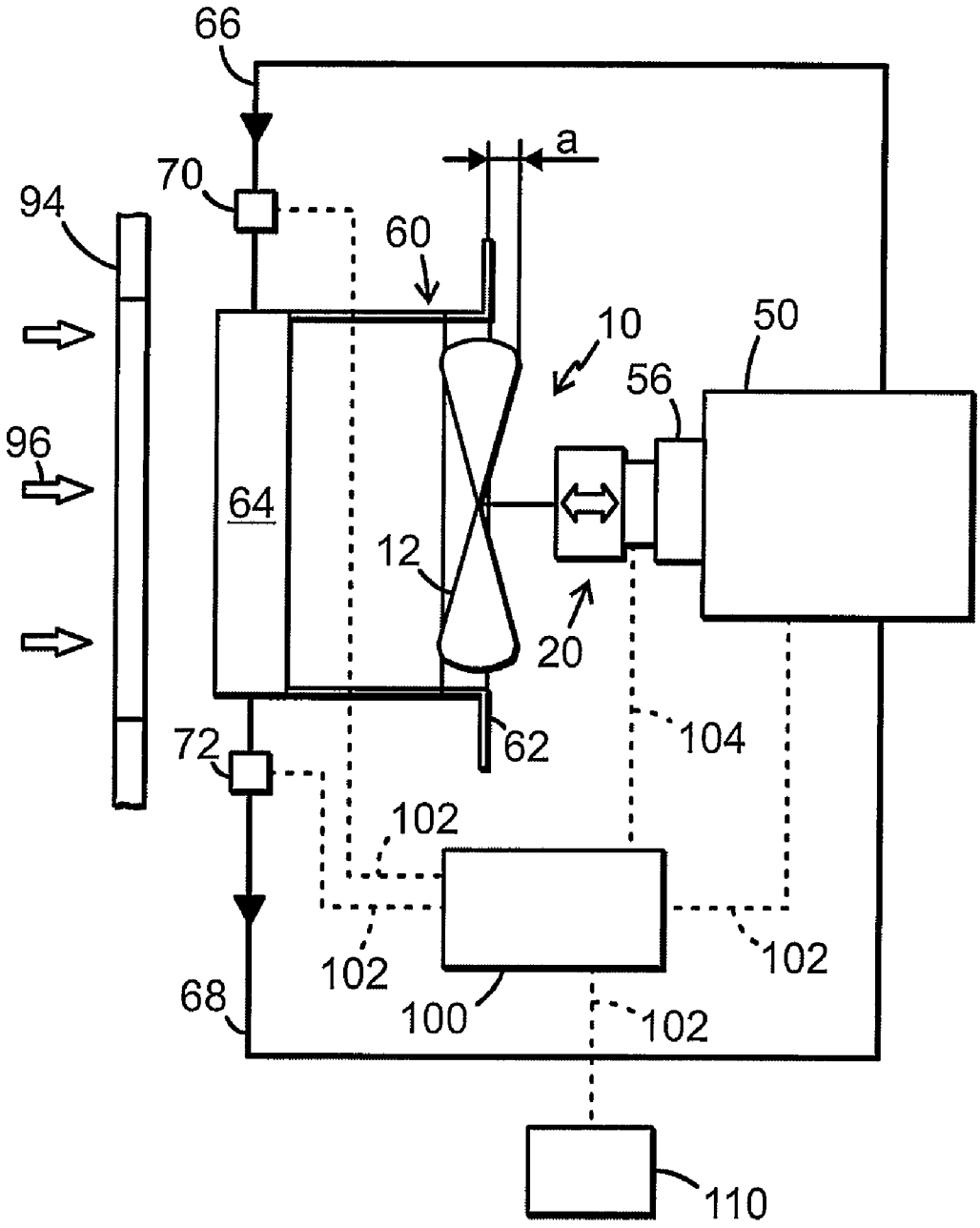
FIG. 1 is a schematic sideview, partly in section, of a shaft-driven cooling fan according to the invention.
Figure 2:
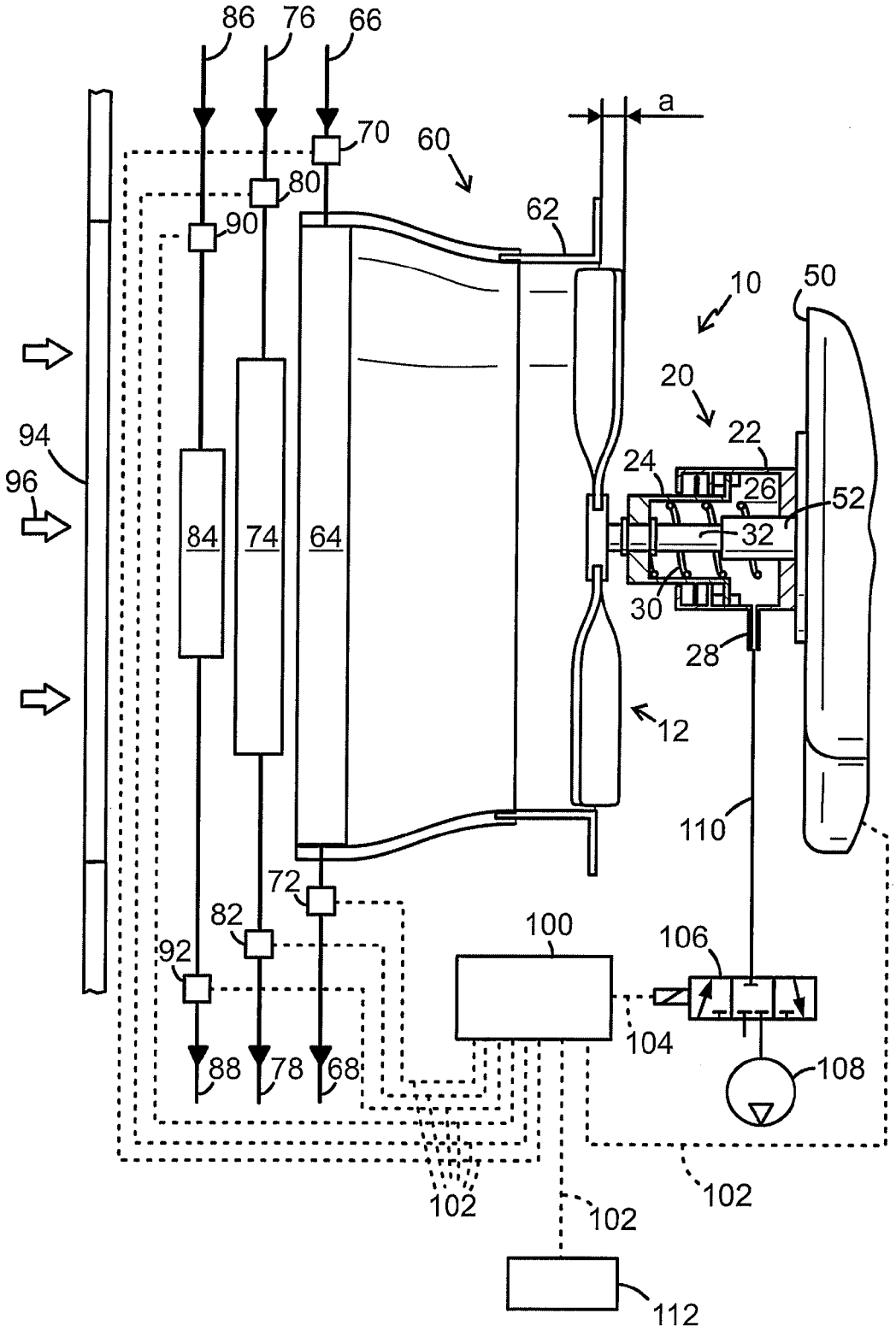
FIG. 2 is a more detailed view corresponding to FIG. 1.

FIGS. 1 and 2 depict schematically a cooling fan 10 fitted on a vehicle engine 50 behind a front portion 94 of a motor vehicle not depicted in more detail. The fan 10 has a rotor 12 arranged adjacent to the rear end of a fan casing 60. The casing 60 extends as far as a radiator arrangement which comprises an engine radiator 64. An inlet line 66 for cooling fluid extends from the engine 50 into the radiator 64, and an outlet line 68 extends from the radiator 64 into the engine 50 in order in a known manner to circulate the cooling fluid through the radiator 64 and the engine 50. The cooling fluid is cooled by giving off heat to outside air 96 which is drawn in by the fan 10 via the front portion 94 through the radiator 64.

Figure 5:
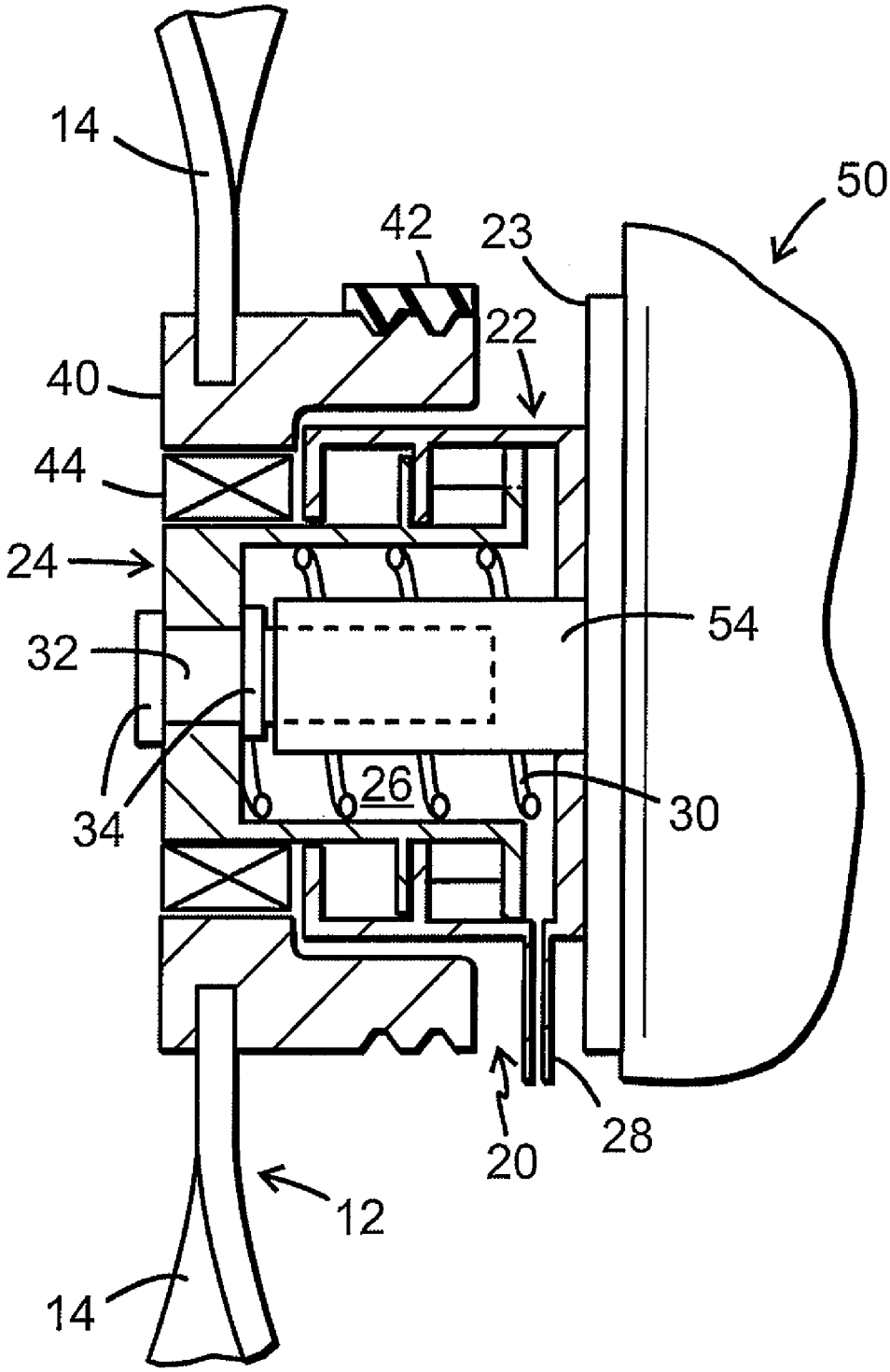
FIG. 5 is a view corresponding to FIG. 3 of a positioning unit with a belt-driven fan.

The speed of the cooling fan 10 may be regulated in various ways, e.g. by an undepicted electronically controlled fan coupling of viscosity type which may be situated in the fan hub, or in some other way in a belt circuit for the fan drive in cases where the fan is belt-driven as in the embodiment depicted in FIG. 5. FIG. 1 depicts a speed regulator 56 which may for example comprise a hydrodynamic coupling which reduces the fan speed in response to increasing engine speed. The fan speed should always be as low as possible in order to minimise losses, reduce noise and reduce the load on, for example, a belt circuit in cases where the fan is belt-driven.

As illustrated in FIG. 2, there may be further coolers, e.g. a charge air cooler 74 and an AC cooler 84, i.e. a cooler for air conditioning of the vehicle's undepicted cab. These further coolers 74, 84 also have respective inlet lines 76, 86 and outlet lines 78, 88 for circulation of cooling fluid through the coolers 74, 84 and undepicted associated units which are to be cooled thereby.

According to the invention, there is a positioning unit or an actuator 20 for moving the fan rotor 12 to positions which involve various amounts of protrusion "a" from an end at a terminating fan ring 62 of the fan casing 60. Although the actuator 20 may be of various kinds, e.g. an electrical or hydraulic actuator, a pneumatic actuator 20 is depicted in the embodiments according to FIG. 2-5.

Figure 3:
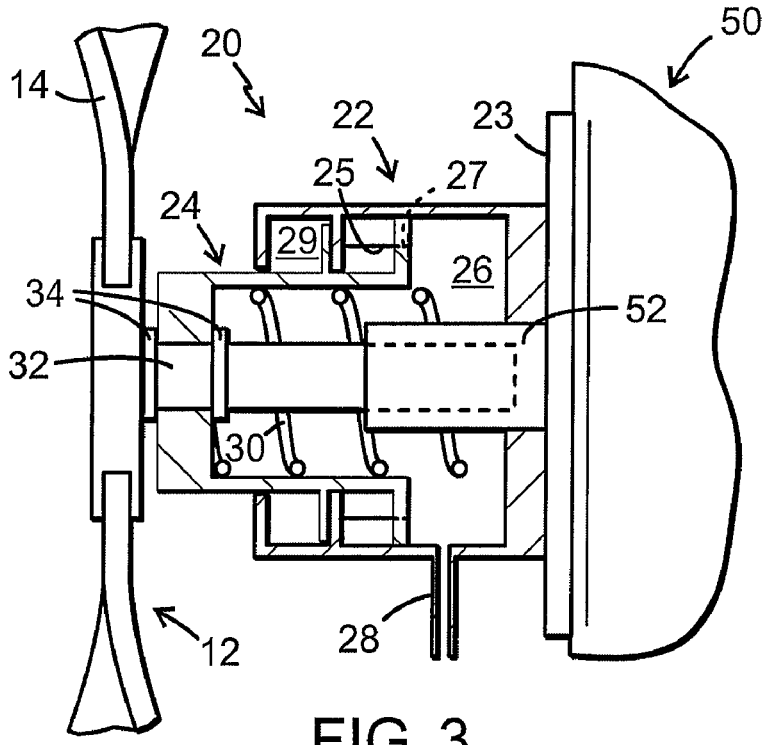
FIG. 3 is a schematic sideview on a larger scale with a positioning unit in a position for maximum protrusion of the fan rotor.

The pneumatic actuator 20 may in the various embodiments be regarded as comprising a cylinder 22 and, supported for movement therein, a hollow piston rod 24, which cylinder and piston rod delineate a chamber 26. As illustrated in FIG. 3, the piston rod 24 may be supported in, and for joint rotation with, the cylinder 22 by ridges 25 and grooves 27 and may also be sealed relative to the cylinder 22 by a schematically depicted seal 29, e.g. a labyrinth seal. The cylinder 22 may have a rear element 23 firmly connected to the engine 50, e.g. by undepicted bolted connection.

As may be seen in more detail in FIG. 2, the cylinder 22 has an inlet/outlet aperture 28 which is in communication with a vacuum source or negative-pressure source 108, e.g. a suction pump, via a line 110 and a valve 106. In the valve position depicted in FIG. 2, the chamber 26 is separated from the environment, and the negative pressure prevailing in the chamber 26 is balanced against the force of a compression spring 30 so that the piston rod 24 is kept in a certain position. Switching the valve 106 to the left puts the chamber 26 into communication with the negative-pressure source 108, with the result that the piston rod 24 moves to the right in FIG. 2. Switching the valve 106 to the right puts the chamber 26 into communication with the atmosphere, with the result that the piston rod 24 moves to the left under the force exerted by the compression spring 30. The movement of the piston rod 24 stops when the valve 106 reverts to its depicted central position. Instead of a negative-pressure source 108, the actuator may in an undepicted manner be powered by a positive-pressure source, e.g. a compressed air container in the vehicle. In that case the compression spring 30 does of course have to be replaced by an undepicted spring acting in the opposite direction.

Figure 4:
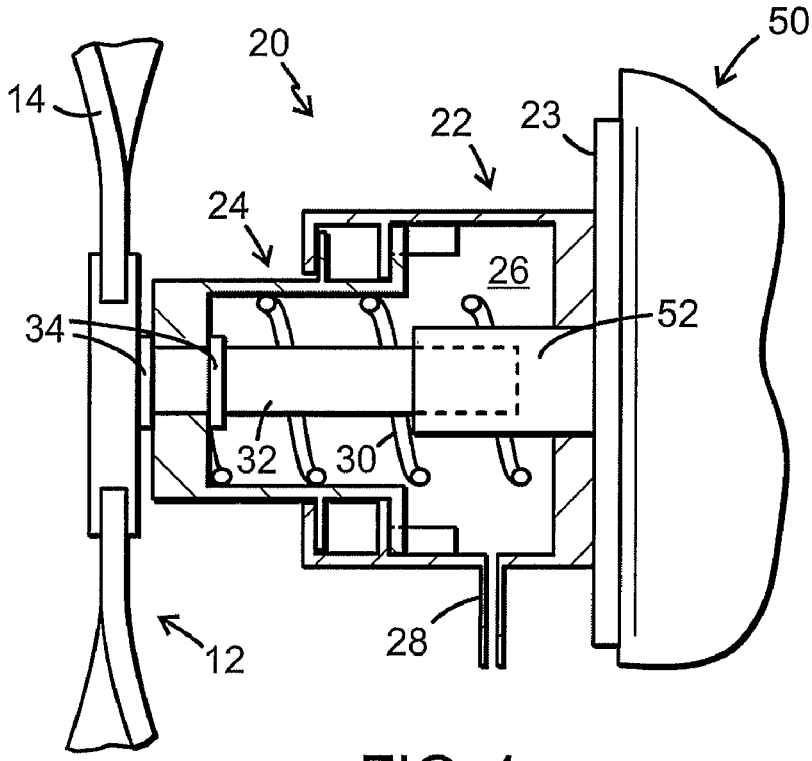
FIG. 4 is a view corresponding to FIG. 3 with the positioning unit in a position for minimum protrusion of the fan rotor.

As most clearly illustrated in FIGS. 3-5, a shaft spigot 32 for the fan rotor 12 extends through the actuator 20. The shaft spigot 32 is firmly connected axially to the end of the piston rod 24 by a pair of shaft flanges 34 so that the shaft spigot 32 and the fan rotor 12 are caused to accompany the linear movements of the piston rod 24.

In the embodiment depicted in FIGS. 2-4, the fan rotor 12 is driven by an engine shaft 52 which need not necessarily be a crankshaft of the engine 50. In this case the shaft spigot 32 is capable of linear movement but is connected to, and for rotation with, the engine shaft 52 in order to constitute a telescopic shaft, e.g. via an undepicted splined connection.

In the embodiment depicted in FIG. 5, the fan rotor 12 is driven by a belt transmission comprising a driving belt 42 and a pulley 40 which may be integral with the hub of the fan rotor 12 which supports the fan blade 14 of the cooling fan 10. In this case, the hub/pulley 40 is therefore supported to rotate freely on the piston rod 24 via rotary bearings 44. There may also be a fixed supporting shaft 54 in which the shaft spigot 32 is supported for linear movement, e.g. via splined connection. In that case the supporting shaft 54 may be connected firmly to the rear element 23 of the cylinder 22. The undepicted other pulleys of the belt transmission may be capable of limited axial movement to prevent obliquity of the driving belt 42 during operation of the actuator 20 when the cooling fan 10 is in operation.

Reverting to FIGS. 1 and 2, these depict a control system for optimising the efficiency of the cooling fan 10 on the basis of current fan speed and vehicle velocity.

The control system comprises an electronic control unit 100 which receives input signals relating to the cooling requirement via a number of signal transmissions, e.g. signal lines 102. In response to these input signals, a processor in the control unit 100 calculates output signals for a signal transmission 104 for switching the actuator 20 to impart to the cooling fan 10 a degree of protrusion "a" from the end of the fan casing 60 which is optimum for the respective operating state.

For each operating state, which may be defined as a combination of fan speed and vehicle velocity, there is an optimum fan protrusion (axial position of the fan) "a" which results in best efficiency of the fan and hence lowest fuel consumption. Correctly set fan protrusion also makes it possible to minimise the recirculation of warmed cooling air. Recirculation is mainly a problem in severely loaded cooling systems at low vehicle velocities and high fan speeds, such as when vehicles travel uphill in high ambient temperatures.

At a maximum cooling requirement, the fan rotor 12 is fully retracted in the casing 60, and at a minimum cooling requirement the fan rotor 12 is subjected to maximum protrusion from the casing 60.

As illustrated in FIGS. 1 and 2, the signal transmissions 102 may transmit signals from a number of temperature sensors 70, 80, 90 and 72, 82, 92 which signal to the control unit 100 the inlet temperature and outlet temperature respectively of the associated cooling devices 64, 74, 94. The difference between inlet temperature and outlet temperature of the respective cooling devices may then serve as parameters for calculating the cooling requirement. As further illustrated in FIGS. 1 and 2, there may also be signal transmissions for current engine temperature.

Other parameters relating to the cooling requirement may comprise current fan speed signalled by some other undepicted sensor or by a vehicle computer 112, which then calculates the current fan speed on the basis of, for example, current engine speed and likewise signals it to the processor of the control unit. The vehicle computer unit 112 or the control unit 100 may also have in a memory a ready-made "chart" of set-point values for the protrusion "a" of the fan rotor 12 in all conceivable operating states as a function of the various operating parameters, so that the fan rotor 12 is subjected, in each operating state, to a specified degree of protrusion "a" based on current operating parameters. The chart may for example be arranged to indicate the rotor protrusion values "a" which in each operating state result in a maximum efficiency of the fan.

In general terms it may be considered that the fan speed is determined by the cooling requirement and that the fan speed should be as low as possible. The required fan speed will itself require a corresponding optimum rotor protrusion which optimises the efficiency of the fan at the particular operating point. It is generally the case that a fully retracted rotor position, i.e. a minimum distance "a", results in a substantially axial flow pattern downstream of the fan, whereas a fully extended rotor position, i.e. a maximum distance "a", results in a large radial component in the cooling air flow pattern downstream of the fan. The position which is optimum may be regarded as depending partly on the particular installation and partly on the current operating state.

The description set out above is primarily intended to facilitate comprehension and no unnecessary limitations of the invention are to be inferred therefrom. The modifications which will be obvious to one skilled in the art from perusing the description may be implemented without departing from the concept of the invention or the scope of the claims set out below.

The invention claimed is:

1. A cooling fan for a vehicle engine, comprising:

a fan casing having an axial end;

a fan rotor which is movable axially relative to the fan casing during operation of the fan rotor;

an actuator for moving the fan rotor to axial positions which represent various degrees of protrusion from the axial end of the fan casing such that the fan casing and the fan rotor are configured for optimising the fan's suction capacity and efficiency on the basis of current operating parameters, including fan speed and vehicle velocity, sensors for detection of magnitudes relating to a cooling requirement at the engine, and a control unit connected, configured and operable for switching the actuator for moving the fan rotor in response to signals from the sensors.

2. A cooling fan according to claim 1, wherein the sensors comprise temperature sensors for detection of cooling fluid temperature of the engine.

3. A cooling fan for a vehicle engine, comprising:

a fan casing having an axial end;

a fan rotor which is movable axially relative to the fan casing during operation of the fan rotor; and an actuator for moving the fan rotor to axial positions which represent various degrees of protrusion from the axial end of the fan casing such that the fan casing and the fan rotor are configured for optimising the fan's suction capacity and efficiency on the basis of current operating parameters, including fan speed and vehicle velocity, wherein the actuator comprises a cylinder and a piston rod and the fan rotor is connected with the piston rod to be moved thereby.

4. A cooling fan according to claim 3, wherein the actuator is a fluid-powered actuator.

5. A cooling fan according to claim 3, further comprising an attachment for supporting the fan rotor for rotation relative to the piston rod.

6. A cooling fan according to claim 5, wherein the attachment comprises a telescopic shaft on which the fan rotor is supported and the shaft extends through the actuator.

7. A cooling fan according to claim 6, wherein the telescopic shaft is a drive shaft for the fan rotor.

8. A cooling fan according to claim 5, further comprising a belt transmission configured for driving the fan rotor to rotate.

9. A cooling fan according to claim 8, wherein the fan rotor includes a hub which comprises a pulley for a driving belt of the belt transmission.

10. A cooling fan according to claim 3, wherein the actuator is configured to move the fan rotor from a first axial position, corresponding to a first set of current operating parameters, to at least a second axial position while the fan rotor is operating, the second axial position corresponding to a second set of current operating parameters.

* * * * *